US005795442A

United States Patent [19]

Boyd et al.

[11] Patent Number: 5,795,442

[45] Date of Patent: Aug. 18, 1998

[54] SEALING DEVICE FOR A TWIN WIRE DEWATERING APPARATUS

[76] Inventors: Donald L. Boyd, 8269 Jellison St., Arvada, Colo. 80005; William M. Fields, 4670 Independence Trail, Evergreen, Colo. 80439

[21] Appl. No.: 610,084

[22] Filed: Mar. 1, 1996

[51] Int. Cl.[6] ..... D21F 1/58

[52] U.S. Cl. ..... 162/353; 162/301

[58] Field of Search ..... 162/353, 300, 162/301, 331

[56] References Cited

U.S. PATENT DOCUMENTS

| | | | |
|---|---|---|---|
| 3,563,854 | 2/1971 | Nisser et al. | 162/353 |
| 5,298,127 | 3/1994 | Beran | 162/353 |

OTHER PUBLICATIONS

Twin Wire Thickening/Wet Lapping of Fields & Boyd.

*Primary Examiner*—Peter Chin
*Assistant Examiner*—Jose A. Fortuna
*Attorney, Agent, or Firm*—Klaas, Law, O'Meara & Malkin, P.C.; Joseph J. Kelly, Esq.

[57] ABSTRACT

A sealing device for sealing the opposite sides of upper and lower converging liquid pervious moving belts used in dewatering a liquid slurry containing fibrous materials wherein the upper and lower liquid pervious belts converge from an entrance portion to an exit portion and wherein the sealing device is formed from an elastomeric material and has a base portion and two integral diverging lip portions which taper vertically and horizontally from the entrance portion to the exit portion. The inner surfaces of each lip portion has a first tapered surface extending from at least adjacent to the entrance portion to at least adjacent to the exit portion of the apparatus and a second tapered surface extending from at least adjacent to the exit portion to at least adjacent to the entrance portion of the apparatus. Each sealing device is preferably formed as two sections each of which may be adjusted for vertical, horizontal and pivotal adjustment.

20 Claims, 3 Drawing Sheets

SEALING DEVICE FOR A TWIN WIRE DEWATERING APPARATUS

FIELD OF THE INVENTION

This invention relates generally to twin wire dewatering apparatus and more specifically to a sealing device for use in providing an effective seal in the converging portion of such apparatus.

BACKGROUND OF THE INVENTION

In a conventional twin wire dewatering apparatus, a highly diluted liquid slurry containing fibrous material is fed from a headbox through suitable apparatus into a location between upper and lower liquid pervious belts. The term belt as used herein includes wire, fabric and any other word used to identify the structure that retains the solids and allows removal of the liquid in this type of apparatus. In this type of apparatus, a common method used for sealing the side edges of the moving belts uses metal or rigid plastic seals. Some of the disadvantages of these metal or rigid plastic seals include leakage because of the lack of full contact with the moving belts and a seal had to be designed for each type of apparatus since the side edge openings thereof would be different. In the first portion of the apparatus, the upper and lower liquid pervious belts are guided by suitable structures for movement over relatively fixed liquid removing apparatus in substantially fixed planes so that they converge from an entrance of the first portion of the apparatus to an exit of the first portion of the apparatus. In order to avoid side leakage and to provide the resulting product with the desired shape, it is necessary to provide each side edge of the upper and lower fluid pervious belts with an effective seal. Furthermore, it is most desirable that the seal be capable of functioning with different types of twin wire dewatering apparatus that have different dimensions at the entrances and exits thereof in vertical and horizontal directions. Another desirable characteristic of the seal is the life expectancy thereof since the replacement of the seal requires the shut down of the apparatus. Also, an effective seal must be capable of functioning properly over a relatively wide range of pressures in the space defined by the conveying upper and lower liquid pervious belts and the seals between the side edges of the upper and lower liquid pervious belts. One such type of twin wire dewatering apparatus is illustrative in a brochure published by Fields & Boyd, Inc. and marketed under the trade designation Model #WT Twin Wire Wedge Thickener which is incorporated herein by reference thereto. The portion of the apparatus illustrated in the brochure that is relative to the invention in this application is the first portion which is illustrated in orange.

BRIEF DESCRIPTION OF THE INVENTION

This invention provides a sealing device particularly directed to be used in the first portion of a twin wire dewatering apparatus wherein a sealing device having a longitudinal axis is formed from an elastomeric material and has a base portion and two diverging lip portions each of which taper vertically and horizontally from an entrance portion of the first portion of the twin wire dewatering apparatus toward an exit portion thereof. The inner surface of each lip portion has a first surface that tapers at least from a location adjacent to the entrance portion toward the exit portion and a second surface that tapers at least from a location adjacent to the exit portion toward the entrance portion. Each sealing device is preferably formed as two separate sections each of which is movably mounted for vertical, horizontal and pivotal adjustment.

In a preferred embodiment of the invention, there is provided an improvement in apparatus for removing at least a substantial quantity of liquid from a liquid slurry containing fibrous material wherein the liquid slurry is fed from a headbox into the space between upper and lower moving liquid pervious belts having opposite longitudinal side edges and wherein the upper and lower moving liquid pervious belts converge from an entrance portion to an exit portion. At the entrance portion, the fibrous slurry is very dilute while at the exit portion the slurry has become a wet solid substance. The improvement comprises at least two opposite elongated flexible sealing members each of which has a longitudinal axis parallel to the longitudinal axes of the opposite side edges and to the direction of movement of the upper and lower moving liquid pervious belts. One of the at least two opposite elongated flexible sealing members is located adjacent to one of the opposite longitudinal side edges and the other of the at least two elongated flexible sealing members is located adjacent to the other of the opposite longitudinal side edges. The at least two elongated flexible sealing members have facing inner surfaces. Each of the at least two elongated flexible sealing members has a terminal lip end in sealing contact with portions of the upper and lower moving liquid pervious belts. Adjustable mounting means are provided so that each of the two elongated flexible sealing members can be moved in vertical, horizontal and pivotal directions to obtain the desired adjustment thereof. In a preferred embodiment of the invention, each of the at least two elongated flexible sealing members and the structures associated therewith comprise separate first and second sections.

In accordance with this invention, there is disclosed a preferred embodiment of an elongated flexible sealing member for use in the above-described twin wire dewatering apparatus but which may also be useful in providing an effective seal with other types of environments. This preferred embodiment for each part comprises a base portion having two integral lip portions extending or diverging outwardly from the base portion in opposite angular directions. Each of the separate first and second sections has a first end portion and a second end portion with the first end portion of the second section being located adjacent to the second end portion of the first section. Each of the two integral lip portions has a terminal lip end which terminal lip ends are, at the first end portions, spaced apart a distance greater than the distance the terminal lip ends of the two lip portions are spaced apart at the second end portions. Each of the two integral lip portions has an inner surface that extends outwardly from a substantially common center line of the base portion. At least portions of each of the inner surfaces have a first generally planar surface extending from the center line at a predetermined angle and a second generally planar surface extending at a predetermined angle to the first generally planar section. The first generally planar surface section tapers from at least a first location adjacent to the first end portion of the first section to at least a second location adjacent to the second end portion of the second section and the second generally planar surface tapers from at least a third location adjacent to the second end portion of the second section to at least a fourth location adjacent to the first end portion of the first section. This structure ensures an effective seal between the terminal lip ends and the upper and lower moving liquid pervious belts. Each of the two integral lip portions are tapered in the vertical and horizontal directions from the first end portion of the first section to the second end portion of the second section. The first and second elongated flexible sealing members are preferably formed from an elastomeric material such as a polyurethane material having Shore A durometer of between 75 and 90 and which elastomeric material preferably includes a lubricating material.

In a preferred embodiment of the invention, the adjustable mounting means comprise a base having a post extending upwardly therefrom. A block is mounted on the post for sliding movement thereover and is also pivotally mounted on the post. Locking means are provided for locking the block at a desired location on the post. A support arm is mounted for sliding movement relative to the block and locking means are provided for locking the support arm at a desired location. The base portion of each of the at least two elongated flexible sealing members is secured to a mounting plate which mounting plate is secured to the support arm. It is understood that other structures may be used to mount each of the two elongated flexible sealing members as long as such structures permit the vertical, horizontal and pivotal adjustment thereof.

In a preferred embodiment of the invention, the twin wire dewatering apparatus is provided with a transition piece for providing a sliding adjustment of the first end portion of each of the at least two elongated flexible sealing members relative to the transition piece. Each transition piece comprises a mounting plate for attachment to the headbox of the twin wire dewatering apparatus. A guide arm and plug piece has a first portion that is secured to the mounting plate and a second portion extending from the first portion in the direction of the slurry flow from the first end portion toward the second end portion. The second portion has a generally ogival transverse cross-sectional configuration. At least portions of the center line of the base portion each of the elongated flexible sealing members are in contact with at least portions of the second end portion of the transition piece and at least portions of the two integral lip portions are in sealing contact with portions of the upper and lower liquid pervious belts. The second portion has an outer surface, which in a transverse cross-sectional configuration is generally ogival. As the upper and lower liquid pervious belts move in a longitudinal direction from the headbox, they move the two integral lip portions into intimate engagement with the outer surface of the second portion. At this location, the terminal lip ends thereof extend inwardly past the outer side edge of the belt toward the longitudinal axis and are in sealing contact with the upper or lower moving liquid pervious belts.

In some instances, it may be desirable to provide structures so that vertical side edges may be formed on the manufactured product. In a preferred embodiment of the invention, the vertical side forming structure comprises a modification of the base member so that a structure having a generally planar outer surface is located between the two integral lip portions.

BRIEF DESCRIPTION OF THE DRAWINGS

Preferred embodiments of the invention are illustrated in the accompanying drawings in which.

DETAILED DESCRIPTION OF THE INVENTION

Figure 1:
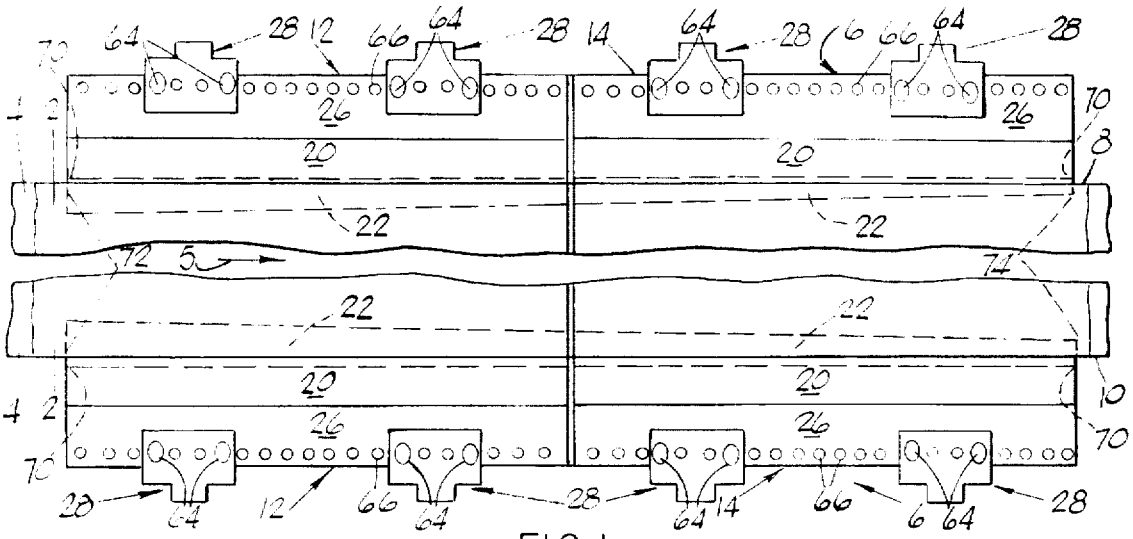
FIG. 1 is a top plan view of a schematic illustration of the apparatus of the invention.

In FIG. 1 there is a schematic illustration of a portion of the first portion of a twin wire dewatering apparatus of the type illustrated in the above-identified Fields & Boyd brochure. An upper liquid pervious belt 2 and a lower liquid pervious belt 4 are part of such apparatus and move in the direction indicated by the arrow 5. In accordance with this invention, there is provided apparatus 6 for sealing the space between the opposite longitudinal side edges 8 and 10 of the moving upper and lower liquid pervious belts 2 and 4 which converge as they move so as to contain a pressurized slurry. For convenience, only one apparatus 6, as illustrated in FIG. 1, will be fully described but it is understood that the other apparatus 6, as illustrated in FIG. 1, has similar structures and functions and similar reference numerals have been applied thereto. The apparatus 6 preferably comprises separate first 12 and second 14 sections. It is understood that in some instances, the apparatus 6 can comprise only one section or more than two sections. The apparatus 6 will be described as one unit and the same reference numerals will be used to identify corresponding structures in the first and second sections 12 and 14.

Figure 2:
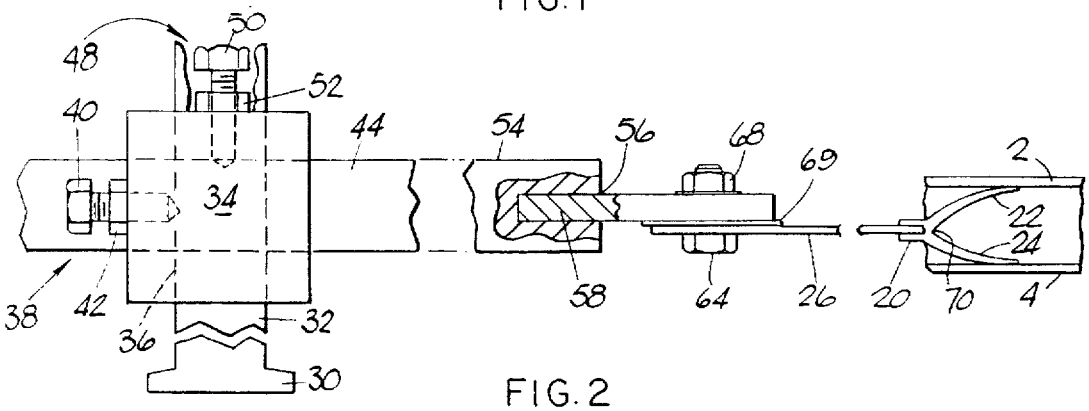
FIG. 2 is a side elevational view with parts in section of the adjustable mounting means of the invention.

The apparatus 6 includes a sealing device comprising a base portion 20 and two diverging integral lip portions 22 and 24, which as illustrated in FIG. 2 are in sealing engagement with the upper and lower liquid pervious belts 2 and 4 and described more fully below. The base portion 20 is secured to a mounting plate 26, preferably as described below. The mounting plate 26 is secured to a plurality of adjustable mounting means 28 so that the apparatus 6 is mounted for vertical, horizontal and pivotal adjustment.

Figure 3:
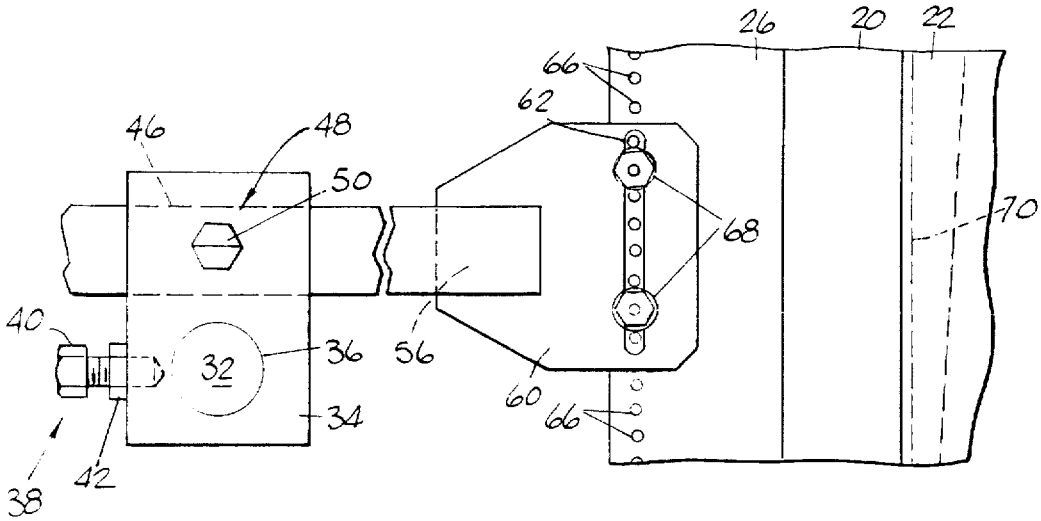
FIG. 3 is a top plan view of FIG. 2.

The adjustable mounting means 28 can comprise various structures but preferably comprise the structures illustrated in FIG. 2 and 3. A support base 30 is mounted at a fixed location, such as on the frame (not shown) of the twin wire dewatering apparatus, and has attached thereto a vertically extending support post 32. A support block 34 is slidingly mounted on the support post 32 with the support post 32 passing through an opening 36 extending through the support block 34 in a vertical direction. Locking means 38 are provided and comprise a threaded bolt 40 threaded in a threaded opening (not shown) in the support block 34 and bears against the support post 32 to hold the support block 34 in the desired vertical location. Pivotal adjustment of the support block 34 is also provided since the opening 36 permits the support block 34 to rotate on the support post 32. After the support block 34 has been moved to a desired vertical and pivotal location and the threaded bolt 40 has been tightened, a lock nut 42 is used to hold the threaded bolt 40 in the locking position. A support arm 44 is slidingly mounted on the support block 34 with the support arm 44 passing through an opening 46 extending through the support block 34. Locking means 48 are provided and comprise a threaded bolt 50 threaded in an opening (not shown) in the support block 34 and bears against the support arm 44 to hold the support arm 44 in the desired location. A threaded nut 52 is used to prevent the loosening of the bolt 50. One end 54 of the support arm 44 has slot 56 formed therein so that a portion 58 of a support plate 60 may be secured therein, preferably by welding (not shown). The support plate 60 has a slot 62 formed therein and is secured to the mounting plate 26 by a plurality of headed threaded bolts 64 extending through openings 66 in the mounting plate 26 and secured by threaded nuts and washers 68. A rubber isolation block 69 is located between the mounting plate 26 and the support plate 60. The sequence of making the vertical, horizontal and pivotal movements of the apparatus 6 may be varied as desired to position the sealing device as desired.

The adjustable mounting means 28 permit the use of the apparatus of the invention with various types of twin wire dewatering apparatus wherein the center line between the upper and lower liquid pervious belts 2 and 4 may be at different heights. Also, the horizontal adjustment permits products of varying widths to be manufactured. The width of the product is governed by the center portion 70 of the sealing device. As illustrated in FIGS. 1 and 3, the lip portion 22 tapers from an entrance portion 72 to an exit portion 74, as explained more fully below. However, as illustrated in FIG. 1, the center portions 70 at the entrance portion 72 and exit portion 74 are spaced apart an equal distance across the upper 2 and lower 4 belts. If desired, the apparatus 6 may be adjusted so that the distance between the center portions 70 at the exit portion 74 is less than the distance between the center portions 70 at the entrance portion 72.

A preferred embodiment of the sealing device of this invention is particularly illustrated in FIGS. 4–8 wherein structures corresponding to those in FIGS. 1–3 have been identified with the same reference numerals. The base portion 20 is molded onto the mounting plate 26 which has plurality of spaced apart openings 80 formed therein so that during the molding operation portions of the material forming the base portion 20 flow through the openings 80 so that the base portion 20 is both adhesively secured to the mounting plate 26 and structurally secured to the mounting plate 26 by the integral portions thereof extending through the openings 80. The base portion 20 and the diverging integral lip portions 22 and 24 are formed from an elastomeric material, such as a polyurethane modified with lubricants to provide for the sliding movement of the upper and lower liquid pervious belts 2 and 4 over the portions 6f the integral lip portions 22 and 24 in contact therewith, or other materials having similar characteristics. The mounting plate 26 is preferably formed from a suitable metallic material, such as stainless steel, but could be formed from a high density plastic material or other materials having similar characteristics.

Figure 4:
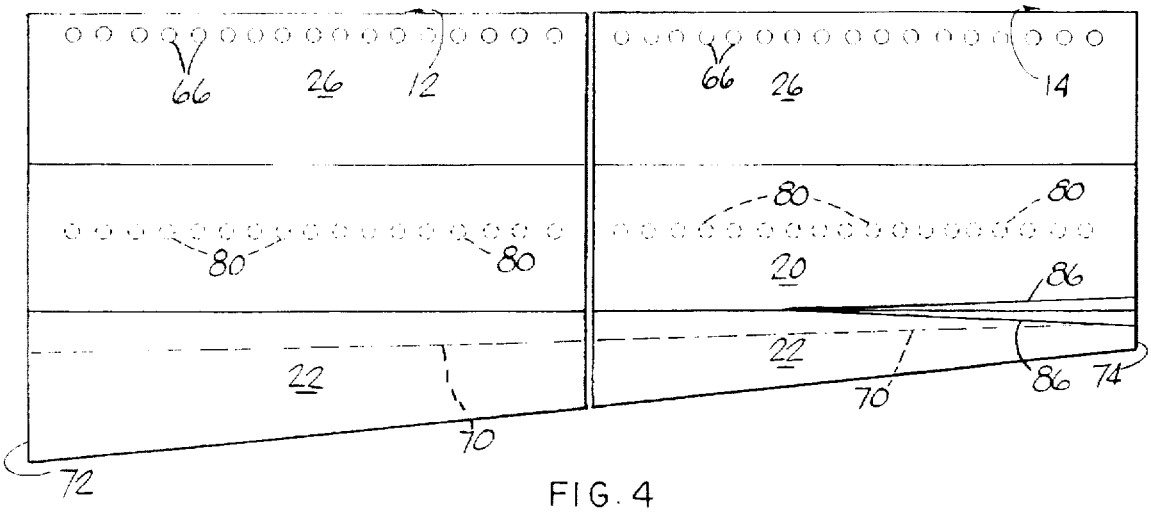
FIG. 4 is a top plan view of the sealing device and mounting plate of the invention.
Figure 5:
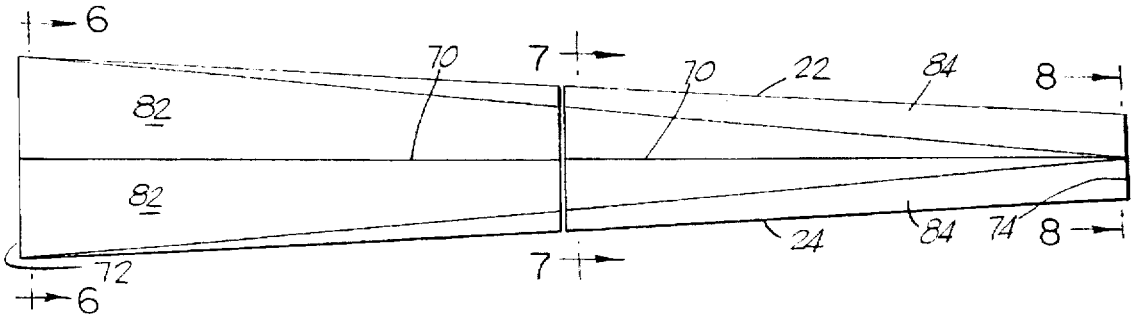
FIG. 5 is an elevational view taken from the bottom of FIG. 4.
Figure 6:
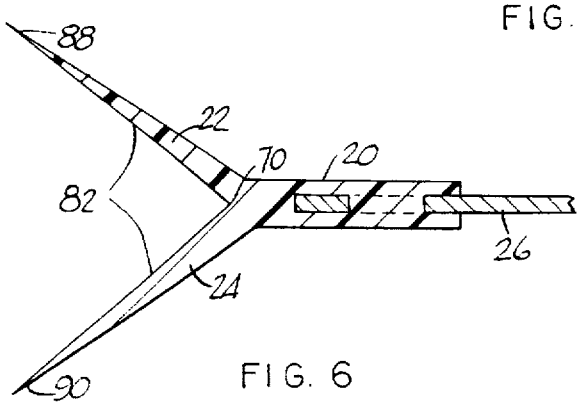
FIG. 6 is a cross-sectional view taken on the line 6—6 of FIG. 5.
Figure 7:
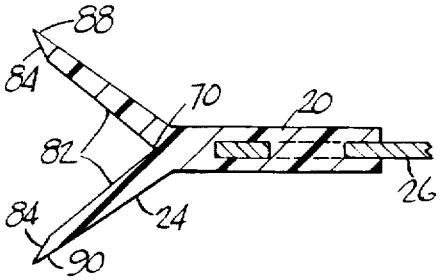
FIG. 7 is a cross-sectional view taken on the line 7—7 of FIG. 5.
Figure 8:
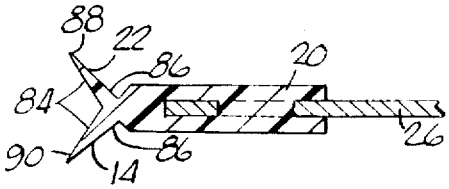
FIG. 8 is a cross-sectional view taken on the line 8—8 of FIG. 5.

As illustrated in FIGS. 4–8, the body portion 20 and the mounting plate 26 has the same dimensions from the entrance portion 72 to the exit portion 74. The integral lip portions 22 and 24 taper in the horizontal direction from the entrance portion 72 to the exit portion 74 as illustrated in FIGS. 1 and 4. Also, as illustrated in FIGS. 5–8, the integral lip portions 22 and 24, taper in a vertical direction from the entrance portion 72 to the exit portion 74. As illustrated particularly in FIGS. 5 and 7, the inner surface of each of the integral lip portions 22 and 24 has a first generally planar surface 82 that tapers from the entrance portion 72 to the exit portion 74 and a second generally planar surface 84 that tapers form the exit portion 74 to the entrance portion 72. Also, a generally V shaped groove 86 is formed in adjacent portions of the outer surface of the base portion 20 and the integral lip portions 22 and 24 to provide flexibility to those portions of the integral lip portions 22 and 24. The generally V-shaped grooves 86 taper from the exit portion 74 toward the entrance portion 72 but only for the approximate distance illustrated in FIG. 4. The integral lip portions 22 and 24 have terminal ends 88 and 90 adapted to be in contact with the upper and lower liquid pervious belts 2 and 4. As illustrated in FIG. 2, when the lip portions 22 and 24 are inserted between the upper and lower liquid pervious belts 2 and 4, the lip portions 82 and 84, as illustrated in FIGS. 6–8, are moved toward each other so as to be resiliently urged against portions of the upper and lower liquid pervious belts 2 and 4 to form an effective seal.

It is understood that the various dimensions of the sealing device may be varied depending on the conditions surrounding the use thereof. The following is a description of a sealing device, for illustration purposes only, for use with twin wire dewatering apparatuses wherein the vertical distance between the upper and lower liquid pervious belts 2 and 4 at the entrance 72 varies between about 2.25 inches and 1.0 inch and at the exit 74 between about 1.00 and 0.125 inch and the pressure exerted by the material between the sealing devices varies between about 2 and 14 psi. For such service, the body portion 20 has a vertical dimension of about 0.3125 inch, a horizontal dimension of about 1.45 inches and each of the first and second sections 12 and 14 a length of about 5.50 feet. The first generally planar surfaces 82 each diverged from a plane passing through the horizontal center of the body portion 20 at an angle of about 40 degrees and the second generally planar surfaces 84 are each included to the first generally planar surface 82 at an angle of about 30 degrees. Each integral lip portions 22 and 24 had an extent of about 1.875 inches at the entrance portion 72 and an extent of about 0.4125 inch at the depth of the V-shaped groove 86 at the exit portion 74.

Figure 9:
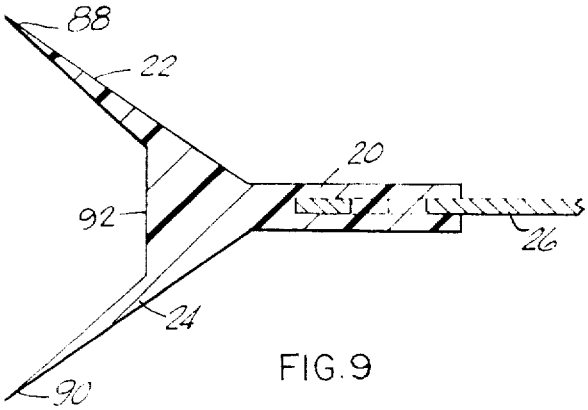
FIG. 9 is a cross-sectional view showing another embodiment of FIG. 6.
Figure 10:
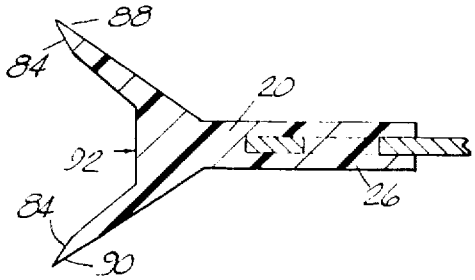
FIG. 10 is a cross-sectional view showing another embodiment of FIG. 7.
Figure 11:
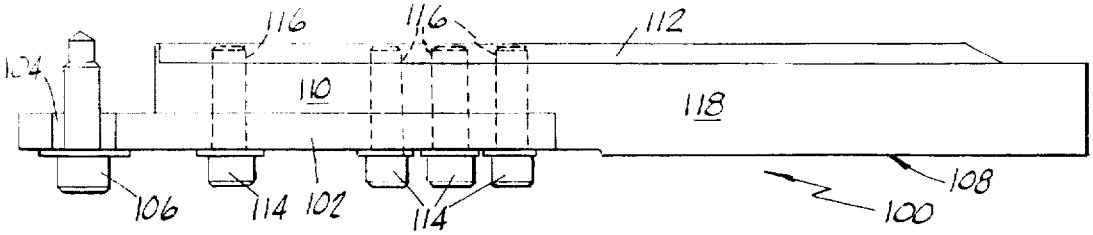
FIG. 11 is a top plan view of an illustration of a transition piece of this invention.
Figure 12:
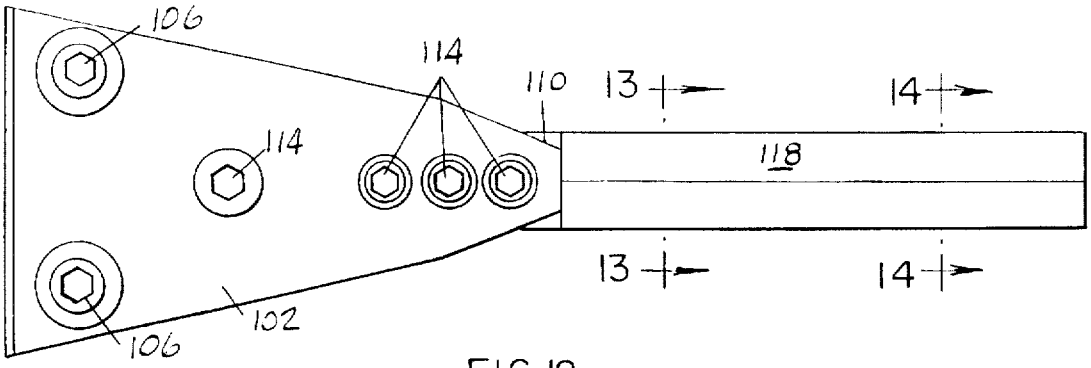
FIG. 12 is an elevational view taken from the bottom of FIG. 11.

In FIGS. 9 and 10, there is illustrated another preferred embodiment of the invention. In some instances, it may be desirable to form vertical side walls on the product being manufactured. A preferred structure, for such a purpose, as illustrated in FIGS. 9 and 10, a solid portion integral with the body portion 20 and the lip portions 22 and 24 so that the resulting structure has a generally planar outer surface 92 formed between the integral lip portions 22 and 24.

Figure 13:
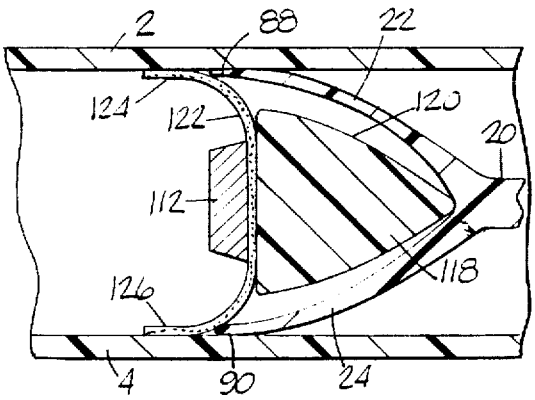
FIG. 13 is a cross-sectional view taken on the line 13—13 of FIG. 12.
Figure 14:
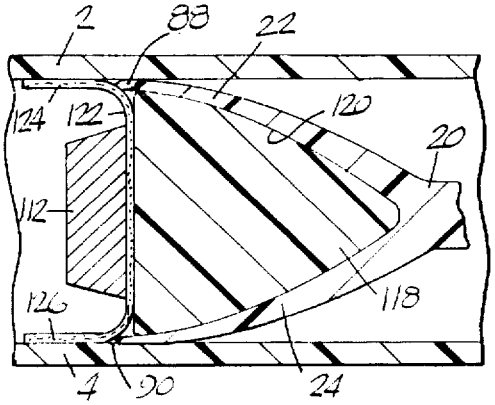
FIG. 14 is an enlarged cross-sectional view taken on the line 14—14 of FIG. 12.

In FIGS. 11–14, there is illustrated a preferred embodiment of a transition piece 100 for use with this invention. The transition piece 100 comprises a mounting plate 102 that is attached to the headbox (not shown) of a twin wire dewatering apparatus. The shape and dimensions of the mounting plate 102 will vary according to the shape and dimensions of the headbox. The mounting plate 102 has openings 104 so that threaded bolts 106 may be used to secure the mounting plate 102 to the headbox. A guide arm and plug piece 108 has a first portion 110 that is clamped between the mounting plate 102 and a clamping bar 112 by headed threaded bolts 114 passing through openings in the mounting plate 102, the first portion 110 and threaded into threaded openings 116 in the clamping bar 112. The guide arm and plug piece 108 has a second portion 118 having an outer surface 120 having a generally ogival transverse cross-sectional configuration, as illustrated in FIGS. 13 and 14. A fabric seal 122 is clamped between the clamping bar 112 and second portion 118. The longitudinal length of the fabric seal 122 will vary with different headboxes. As illustrated in FIGS. 13 and 14, the end portion 124 the fabric seal 122 is in contact with the inner surface of the upper liquid pervious belt 2 and the end portion 126 of the fabric seal 122 is in contact with the inner surface of the lower liquid pervious belt 4. In FIG. 13, the lip portions 22 and 24 are not in contact with the outer surface 120. The cross-sectional view in FIG. 14 has been enlarged, as noted by the difference in size of the second portion 118, so as to be able to illustrate more clearly the various structures. In reality, at the line 14—14 in FIG. 12, the upper and lower liquid pervious belts 2 and 4 are closer together that at the line 13—13 so that they move the lip portions 22 and 24 into contact with the outer surface 120.

As illustrated in FIGS. 1, 4 and 5, the first and second sections 12 are of equal longitudinal length. In some instances, such as a twin wire dewatering apparatus that forms the desired stable product before the exit portion or the twin wire dewatering apparatus does not have the to accommodate the full longitudinal extent of the combined first and second sections 12 and 14, the twin wire dewatering apparatus may not require a full length sealing device. Therefore, the second part 14 may be cut in a transverse direction at any location to accommodate the required longitudinal extent.

It is contemplated that the inventive concepts herein described may be variously otherwise embodied and it is intended that the appended claims be construed to include alternative embodiments of the invention except insofar as limited by the prior art.

What is claimed:

1. A sealing device in an apparatus for removing liquid from a liquid slurry containing fibrous material which liquid slurry is fed from a headbox into the space between converging upper and lower liquid pervious moving belts having opposite longitudinal side edges which belts are guided for movement in substantially fixed planes comprising:

an elongated flexible member mounted adjacent to each of said opposite longitudinal side edges and having a longitudinal axis, a first end portion and a second end portion;

said elongated flexible member having a base portion and two Integral lip portions diverging outwardly from said base portion in opposite angular directions;

each of said two integral lip portions having a terminal end or forming an effective seal with one of said converging upper and lower liquid pervious moving belts;

said terminal ends of said two integral lip portions at said first end portion being spaced apart a distance greater than the distance said terminal ends of said two integral lip portions are spaced apart at said second end portion;

each of said two integral lip portions having an inner surface extending outwardly from a substantially common center line of said base portion;

at least portions of each of said inner surfaces having a first substantially planar surface extending from a center line at a predetermined angle and a second substantially planar surface extending at a predetermined angle to said first substantially planar surface;

said first substantially planar surface being tapered from at least a first location adjacent to said first end portion to at least a second location adjacent to said second end portion; and said second substantially planar surface being tapered from at least a third location, adjacent to said second end portion to at least a fourth location adjacent to said first end portion.

2. A sealing device as in claim 1 wherein:

each of said two integral lip portions being tapered in the vertical direction from said first end portion to said second end portion.

3. A sealing device as in claim 1 wherein:

each of said two integral lip portions being tapered in the horizontal direction from said first end portion to said second end portion.

4. A sealing device as in claim 3 wherein:

said elongated flexible member is formed from an elastomeric material.

5. A device as in claim 3 and further comprising:

adjustable mounting means for mounting said elongated flexible member for vertical, horizontal and pivotal adjustment.

6. A device as in claim 3 wherein:

said elongated flexible member comprising separate first and second sections.

7. A device as in claim 1 and further comprising a transition piece comprising:

a mounting plate for attachment to said headbox;

a guide arm having a first portion secured to said mounting plate and a second portion extending from said first portion in the direction from said first end portion toward said second end portion;

said second portion having an outer surface having an ogival transverse cross-sectional configuration:

at least a portion of said elongated flexible member being contact with at least a portion of said second, end portion; and at least portions of said two integral lip portions being in sealing contact with portions of said upper and lower liquid pervious belts.

8. A device as in claim 7 and further comprising:

each of said two integral lip portions having an inner surface in contact with said outer surface; and said terminal ends of said two integral lip portions projecting inwardly past said outer surface toward said longitudinal axis and being in sealing contact with said upper and lower liquid pervious belts.

9. A device as in claim 8 and further comprising:

a fabric seal having a base portion and opposite diverging lip sealing portion; and clamping means for securing said base portion of said fabric seal to said guide arm.

10. A sealing device in an apparatus for removing liquid from a liquid slurry containing fibrous material which liquid slurry is fed from a headbox into a space between converging upper and lower liquid pervious moving belts having opposite longitudinal side edges and which belts are guided for movement in substantially fixed planes comprising:

an elongated flexible member mounted adjacent to each of said opposite longitudinal side edges and having a longitudinal axis, a first end portion and a second end portion;

said elongated flexible member having a base portion and two integral lip portions diverging outwardly from said base portion in opposite angular directions;

each of said two integral lip portions having a terminal end for forming an effective seal with one of said converging upper and lower pervious moving belts;

said terminal ends of said two integral lip portions at said first end portion being spaced apart a distance greater than the distance said terminal ends of said two integral lip portions are spaced apart at said second end portion;

each of said two integral lip portions having an inner surface extending outwardly from a substantially common center line of said base portion;

at least portions of each of said inner surfaces having a first substantially planar surface extending from a center line at a predetermined angle and a second substantially planar surface extending at a predetermined angle to said first substantially planar surface;

said first substantially planar surface being tapered from at least a first location adjacent to said first end portion to at least a second location adjacent to said second end portion;

said second substantially planar surface being tapered from at least a third location adjacent to said second end portion to at least a fourth location adjacent to said first end portion; and adjustable mounting structures for mounting said elongated flexible member on said apparatus for vertical, horizontal and pivotal adjustment.

11. A device in claim 10 wherein said adjustable mounting structures comprise;

a base;

a post extending upwardly from said base;

a block mounted on said post for sliding movement relative to said post;

locking means for locking said block at a desired location on said post;

a support arm mounted for sliding movement relative to said block;

locking means for locking said support arm at a desired location;

a mounting plate;

said base portion secured to said mounting plate; and securing means for securing said support arm to said mounting plate.

12. In apparatus for removing at least a substantial quantity of liquid from a liquid slurry containing fibrous material wherein the liquid slurry is fed from a headbox Into the space between upper and lower moving liquid pervious belts moving in relatively fixed planes and having opposite longitudinal side edges and wherein the upper and lower moving liquid pervious belts converge from an entrance portion to an exit portion in substantially fixed planes, the improvement comprising:

at least two elongated flexible sealing members, each having a longitudinal axis:

each of said two elongated flexible sealing members having a base portion and two integral lip portions diverging outwardly from said base portion in opposite angular directions:

one of said at least two elongated flexible sealing members being located adjacent to one of said opposite longitudinal side edges and the other of said at least two elongated flexible sealing members being located adjacent to the other of said opposite longitudinal side edges;

said at least two elongated flexible sealing members having facing inner surfaces;

each of said at least two elongated flexible sealing members having portions in sealing contact with portions of said upper and lower moving liquid pervious belts; and adjustable mounting structures mounted on said apparatus for adjusting the distance between said inner surfaces of said at least two elongated flexible sealing members from adjacent to said entrance portion to adjacent to said exit portion to vary the width of the product being produced.

13. Apparatus as in claim 12 wherein: said adjustable mounting structures also providing for vertical and horizontal adjustment of each of said at least two elongated flexible sealing members.

14. Apparatus as in claim 13 wherein each of said at least two elongated flexible sealing members comprises separate first and second sections.

15. Apparatus as in claim 14 wherein said adjustable mounting structures comprise:

a base;

a post extending upwardly from said base;

a block mounted on said post for sliding movement relative to said post;

said block being pivotally mounted on said post;

locking means for locking said block at a desired adjusted location on said post;

a support arm mounted for sliding movement relative to said block;

locking means for locking said support arm at a desired adjusted location;

a mounting plate;

said base portion secured to said mounting plate; and securing means for securing said support arm to said mounting plate.

16. Apparatus as in claim 15 wherein:

each of said separate first and second sections having a first end portion and a second end portion with said first end portion of said second portion being located adjacent to said second end portion of said first section;

each of said two integral lip portions having terminal ends for forming an effective seal with at least a portion of said upper and lower liquid pervious belts;

said terminal ends of said two lip portions of each of said first and second sections at said first end portion being spaced apart a distance greater than the distance said terminal ends of said two lip portions of each of said first and second sections are spaced apart at said second end portion;

each of said two integral lip portions having an inner surface extending outwardly from a substantially common center line of the base portion;

at least portions of each of said inner surfaces having a first substantially planar surface extending from a center line at a predetermined angle and a second substantially planar surface extending at a predetermined angle to said first substantially planar surface;

said first substantially planar surface being tapered from at least a first location adjacent to said first end portion to at least a second location adjacent to said second end portion; and said second substantially planar surface being tapered from at least a third location adjacent to said second end portion to at least a fourth location adjacent to said first end portion.

17. Apparatus as in claim 16 wherein:

each of said two integral lip portions being tapered in both the horizontal and vertical directions from said first end portion to said second end portion.

18. Apparatus as in claim 17 and further comprising a transition piece comprising:

a mounting plate for attachment to said headbox;

a guide arm having a first portion secured to said mounting plate and a second portion extending from said first portion in the direction from said first end portion toward said second end portion;

said second portion having an outer surface having a generally ogival transverse cross-sectional configuration;

at least a portion of said elongated flexible member being in contact with at least a portion of said second end portion;

at least portions of said two integral lip portions being in sealing contact with portions of said upper and lower liquid pervious belts;

a fabric seal having a base portion and opposite diverging lip sealing portion; and clamping means for securing said base portion of said fabric seal to said guide arm.

19. Apparatus as in claim 6 wherein:

each of said two integral lip portions being tapered in the vertical direction from said first end portion to said second end portion.

20. Apparatus as in claim 16 wherein:

each of said two integral lip portions being tapered in the horizontal direction from said first end portion to said second end portion.

* * * * *

UNITED STATES PATENT AND TRADEMARK OFFICE

CERTIFICATE OF CORRECTION

PATENT NO. : 5,795,442

DATED : August 18, 1998

INVENTOR(S) : Boyd et al.

It is certified that error appears in the above-identified patent and that said Letters Patent is hereby corrected as shown below:

Column 5, (line 55), delete "6f" and insert therefor --of--.

In the Claims

Column 7, (line 45), delete "Integral" and insert therefor --integral--.

Column 7, (line 54), after "terminal" do not start new line.

Column 8, (line 2), after "location" delete ".".

Column 8, (line 33), after "being" insert --in--.

Column 8, (line 34), after "second" delete ",".

Column 9, (line 43), delete "Into" and insert therefor --into--.

Column 10, (line 7), after "wherein:" start new line.

Signed and Sealed this

Second Day of February, 1999

*Attest:*

*Attesting Officer*

*Acting Commissioner of Patents and Trademarks*